US005612672A

United States Patent [19]

Ino et al.

[11] Patent Number: 5,612,672

[45] Date of Patent: Mar. 18, 1997

[54] ENGINE COOLING FAN DIAGNOSIS DEVICE

[75] Inventors: Yukihiro Ino; Youichi Kishimoto; Atsushi Iochi; Makoto Shoji, all of Kanagawa, Japan

[73] Assignee: Nissan Motor Co., Ltd., Kanagawa, Japan

[21] Appl. No.: 529,898

[22] Filed: Sep. 18, 1995

[30] Foreign Application Priority Data

Sep. 22, 1994 [JP] Japan ..... 6-228336

[51] Int. Cl.[6] ..... B60Q 1/00

[52] U.S. Cl. ..... 340/449; 340/441; 123/41.12; 123/41.15; 123/41.31

[58] Field of Search ..... 340/450.3, 460, 340/441, 449, 438; 123/41.12, 41.15, 41.31, 41.48, 41.49

[56] References Cited

U.S. PATENT DOCUMENTS

| | | | |
|---|---|---|---|
| 4,263,822 | 4/1981 | Harmon | 477/64 |
| 4,348,653 | 9/1982 | Tsuzuki et al. | 340/449 |
| 4,419,730 | 12/1983 | Ito et al. | 340/449 |
| 4,752,883 | 6/1988 | Asakura et al. | 340/441 |
| 4,857,889 | 8/1989 | Terano et al. | 340/449 |
| 4,977,743 | 12/1990 | Aihara et al. | 123/41.31 |
| 4,977,862 | 12/1990 | Aihara et al. | 123/41.12 |
| 5,107,246 | 4/1992 | Magaki | 340/449 |
| 5,133,303 | 7/1992 | Umerhara | 123/41.15 |
| 5,201,284 | 4/1993 | Umerhara | 123/41.15 |
| 5,224,446 | 7/1993 | Okita et al. | 123/41.12 |

FOREIGN PATENT DOCUMENTS 4-143438 5/1992 Japan .

*Primary Examiner*—Brent A. Swarthout
*Assistant Examiner*—Van T. Trieu
*Attorney, Agent, or Firm*—Lowe, Price, LeBlanc & Becker

[57] ABSTRACT

A vehicle engine temperature is detected, and a radiator fan fault warning is given so as to prevent engine overheating when this temperature rises to or above a preset determining value under a predetermined test conditions. Preferably, it is determined that the radiator fan has a fault when a temperature equal to or above this determining value holds for at least a predetermined time. More preferably, this determining value is set low while the vehicle is in motion. By providing these supplementary conditions, incorrect diagnosis of a fault in the radiator fan is prevented.

15 Claims, 4 Drawing Sheets

ENGINE COOLING FAN DIAGNOSIS DEVICE

FIELD OF THE INVENTION

This invention relates to a diagnosis system for an engine cooling fan.

BACKGROUND OF THE INVENTION

In water-cooled car engines, the cooling system may for example comprise a water jacket fitted to an engine cylinder block and cylinder head, a radiator and a water pump. The water pump is driven by an engine crankshaft via a belt, cooling water being recirculated between the water jacket and radiator.

Water which has been heated by absorbing engine heat in the water jacket is led to the radiator, where this heat is dissipated to the atmosphere.

The radiator is cooled by a radiator fan and by wind depending on the vehicle speed. Modern cooling devices are provided with a fan rotated by an electric motor so that a predetermined wind volume is supplied when the vehicle speed and engine speed are low, such as when the vehicle is climbing a hill or in a traffic jam.

In the same way as a fuel injection amount from a fuel injector is centrally controlled by an ECU (Electronic Control Unit), the radiator fan is controlled by a command signal from the ECU, and started and stopped according to vehicle speed, cooling water temperature and air conditioner operating conditions.

However, if the radiator fan breaks down when the vehicle is climbing a hill or in summer so that it is no longer able to dissipate heat, cooling water reaches boiling point and steam is generated which escapes from the overflow pipe.

To prevent this overheating, a correction may be made to increase the amount of fuel injected by the injector when the cooling water temperature exceeds for example 100° C. Alternatively, Tokkai Hei 4-143438 published by the Japanese Patent Office in 1992 discloses a method wherein fuel is cut off regardless of running conditions when the cooling water temperature rises above for example 145° C.

However, according to the aforesaid former method where the fuel amount is increased for high water temperature, the air-fuel ratio tends to be richer than the theoretical air-fuel ratio which leads to an increase of CO and HC in the exhaust. According to the latter method, if fuel is cut off when it is desired to accelerate, the driver cannot obtain the desired acceleration.

SUMMARY OF THE INVENTION

It is therefore an object of this invention to warn the driver that the radiator fan has a fault, It is a further object of this invention to prevent an incorrect diagnosis when testing the radiator fan.

It is yet a further object of this invention to perform testing of the radiator fan without being affected by the air intake temperature.

In order to achieve the above objects, this invention provides a fault diagnosis device for a radiator fan that cools an engine of a vehicle comprising a mechanism for detecting a temperature of the engine, a determining mechanism that functions so as to determine whether or not a preset test condition is satisfied, and to determine that the radiator fan has a fault when the engine temperature is greater than a preset first determining value when the condition is satisfied, and a mechanism for generating a warning when the determining mechanism has determined that the fan has a fault.

It is preferable that the device further comprises a timer for measuring an elapsed time for which the engine temperature is greater than the first determining value, and the determining mechanism functions also so as not to determine that tile radiator fan has a fault when the elapsed time does not exceed a predetermined value.

It Is also preferable that the determining mechanism functions also so as not to determine that the radiator fan has a fault when the condition does not hold for a predetermined time.

It is also preferable that the determining mechanism functions also so as to determine whether of not the vehicle is moving, and to determine that the radiator fan has a fault when the vehicle Is in motion and the engine temperature is greater than a second determining value that is less than the first determining value.

In this case, it is further preferable that the device further comprises a timer for measuring an elapsed time for which the engine temperature is greater than the second determining value, and the determining mechanism functions also so as not to determine that the radiator fan has a fault when the elapsed time does not exceed the predetermined value.

It is also preferable that the device further comprises a mechanism for detecting a temperature of air provided to the engine, and the determining mechanism functions also so as to increase the second determining value when the temperature is greater than a preset predetermined value.

It is also preferable that the vehicle comprises a high speed gear and a low speed gear that reduce the engine speed, the device further comprises a mechanism for detecting an applied gear, and the determining mechanism functions also so as not to determine that the radiator fan has a fault when the high speed gear is not applied.

It is also preferable that the device further comprises a mechanism for detecting an engine load, and the determining mechanism function also so as not to determine that the radiator fan has a fault when the engine load is greater than a predetermined value.

It is also preferable that the device further comprises a mechanism for detecting an engine speed, and the determining mechanism functions also so as not to determine that the radiator fan has a fault when the engine speed is greater than a predetermined value.

The details as well as other features and advantages of this invention are set forth in the remainder of the specification and are shown in the accompanying drawings.

DESCRIPTION OF THE PREFERRED EMBODIMENTS

Figure 1:
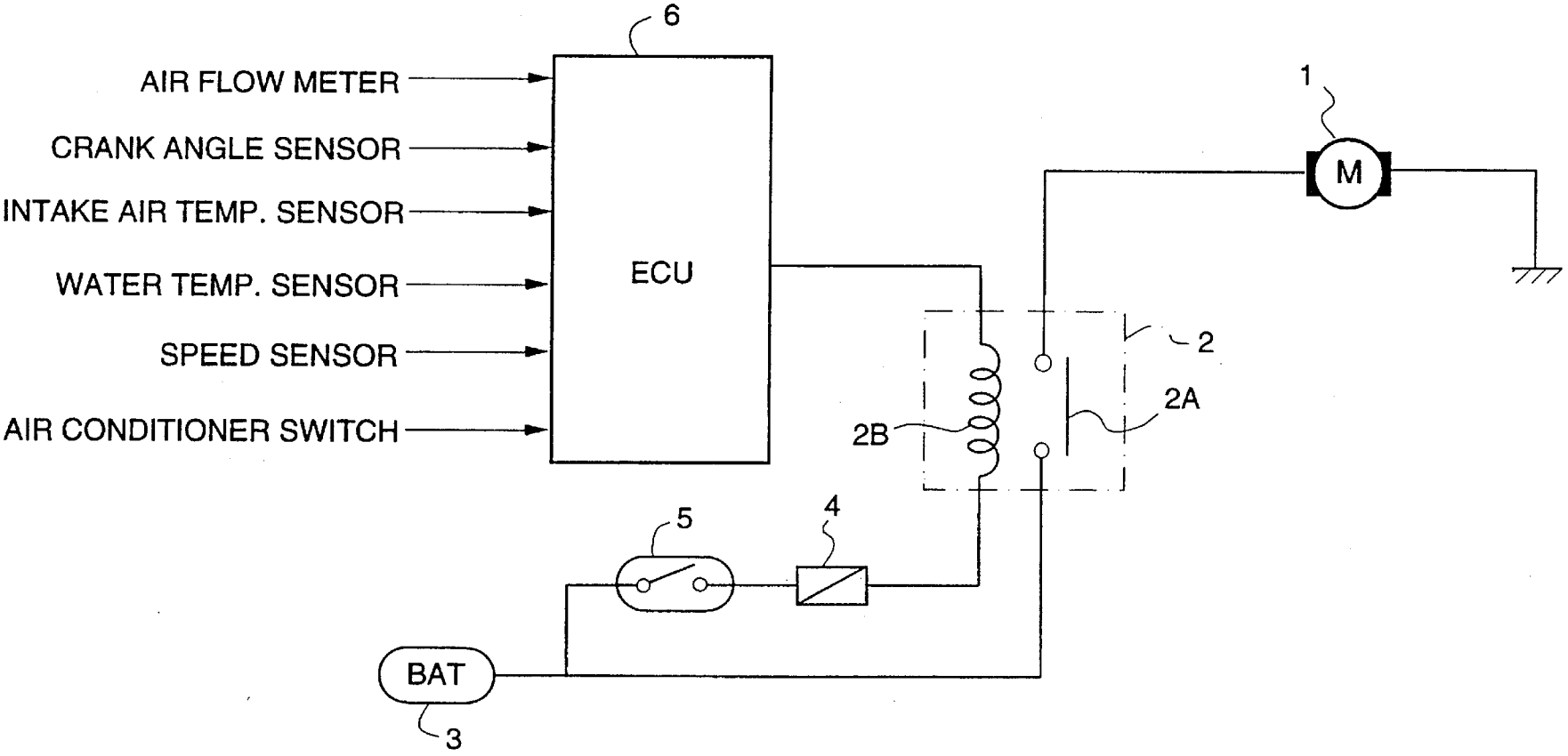
FIG. 1 is a schematic diagram of a test apparatus according to this invention.

Referring to FIG. 1 of the drawings, a fan motor 1 that drives an electric radiator fan is connected to a battery 3 via normally open contacts 2A of a relay 2.

One end of an electromagnetic coil 2B of which the relay 2 is comprised, is connected to the battery 3 via a fuse 4 and a key switch 5.

An ECU 6 comprises mainly a microprocessor. The ECU 6 is provided with an auxiliary switch, not shown, which starts and stops the flow of electricity to the electromagnetic coil 2B. When this auxiliary switch is switched ON after the key switch 5 has been switched ON, current flows in the radiator fan coil 2B, the contacts 2A close, current from the battery 3 is supplied to the fan motor 1 and the electric fan operates.

Signals from a vehicle speed sensor, cooling water temperature sensor, and air conditioner switch are input to the ECU 6. The ECU 6 opens and closes the relay 2 according to these signals.

The conditions under which the electric fan is operated are different depending on the layout of the radiator and engine, the layout of the radiator cooling system and the ventilating capacity of tile electric fan.

According to one example, at a low running speed of 0–19 km/h, the fan operates when the cooling water temperature rises above 100° C, and in the range 20–79 km/h, the fan operates when the cooling water temperature rises above 95° C. At a high running speed of 80 km or more, some cooling can be expected from the wind generated by the movement of the vehicle, so the fan is operated at 105° C or higher. At vehicle speeds of 79 km/h or less, if the air conditioner is operating, the fan is operated regardless of the cooling water temperature.

As shown in FIG. 1, signals relating to air intake volume and engine rotation position are input to the ECU 6 from an air flow meter and crank angle sensor. These signals are used for fuel control, and based on these signals, the ECU 6 controls an amount of fuel injected by a fuel injector, not shown.

However, if the radiator fan no longer functions due to a broken circuit or the like, the engine may overheat. The ECU 6 then performs a fault test on the radiator fan, and if it determined that there is a fault, a lamp on the driver's panel lights to alert the driver.

The following two kinds of fault test are performed:

(1) Regular test when the vehicle is stationary or moving

If the radiator fan is operating, the cooling water does not reach a temperature at which overheating occurs, hence a water temperature at which overheating will definitely occur, for example 145° C., is set as a first determining value. When the cooling water temperature rises above this determining value, it is determined that the radiator fan has a fault.

(2) Test when the vehicle is moving

Even if the radiator fan is damaged while the vehicle is moving, the rise of cooling water temperature will not be so steep due to the cooling effect of the wind generated by the movement of the vehicle. It is therefore difficult to perform a fault test while the vehicle is moving using only the regular test. A second determining value less than the first determining value is therefore set assuming there will be some cooling effect due to this wind, and it is then determined that the radiator fan has a fault when the cooling water temperature rises above this second determining value.

Figure 2:
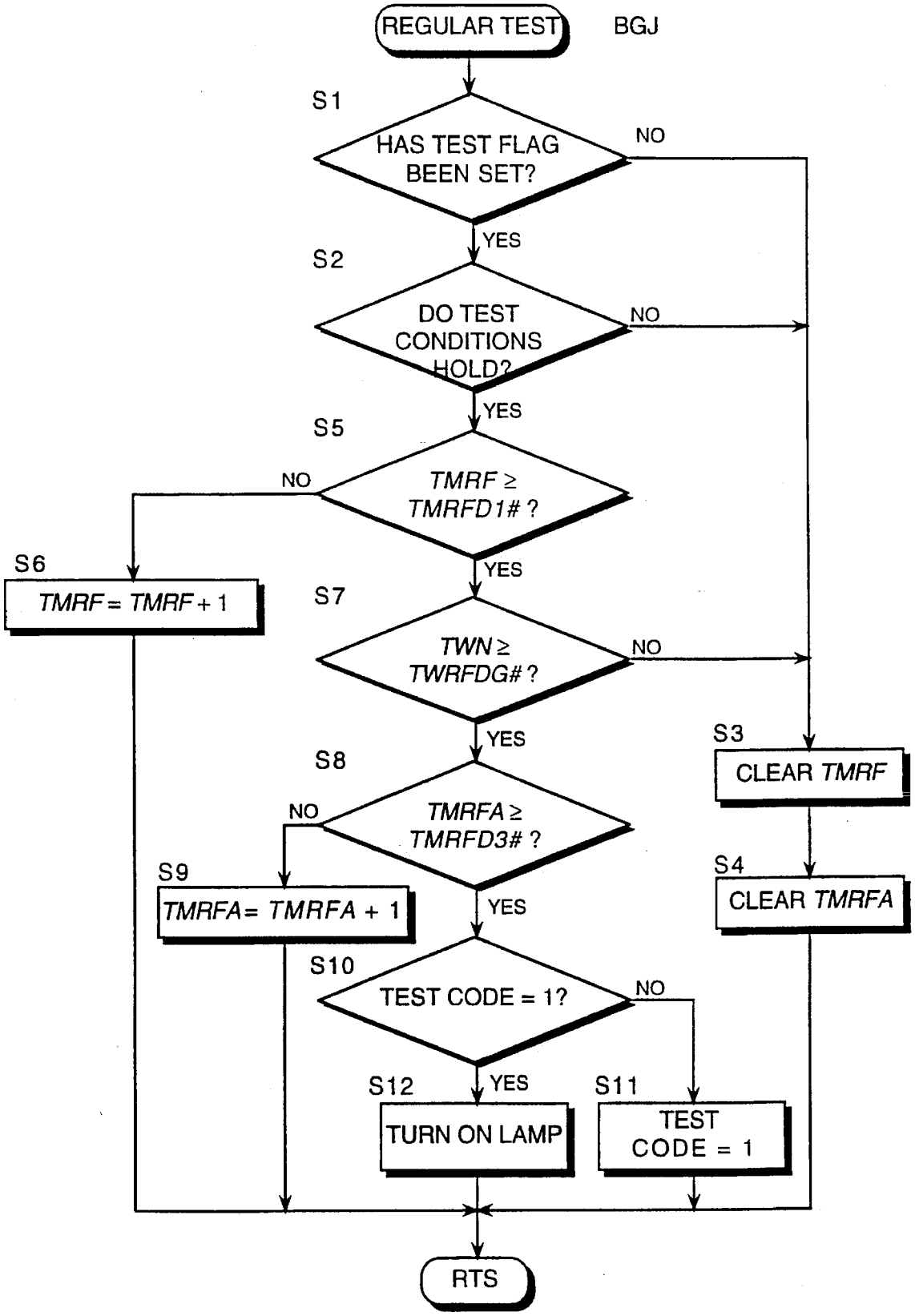
FIG. 2 is a flowchart showing a process of a regular fault test according to this invention.

FIG. 2 is a flowchart of a regular fault test routine which is executed at fixed intervals of, for example, 2 ms. Background Jobs may also be executed. A background job is a routine executed during the period the CPU is available, i.e. the period when neither fixed interval routines nor routines synchronized with the engine speed are being executed.

In a step S1, it is determined whether or not a test flag has been set. In a vehicle wherein this test is not required, this test flag is first reset.

In a step S2, it is determined whether or not the following two conditions are satisfied:

[1] The water temperature sensor, air intake temperature sensor, crank angle sensor and vehicle speed sensor have no faults.

[2] The engine is running.

If either one of these two conditions is not satisfied, the routine advances to steps S3 and S4, two timers are cleared, and the routine is terminated without a test being performed.

Provided both the aforesaid two conditions are satisfied, the routine advances to a step S5.

In the step S5, a timer value TMRF is compared with a predetermined value TMRFD1#, and when TMRF<TMRFD1#, the routine advances to a step S6 and the timer value TMRFD is incremented. TMRFD1# is set to, for example, 60 seconds.

When both steps S1 and S2 have been executed, the timer value is repeatedly incremented in step S6, and when TMRF≧TMRFD1#, the routine advances to a step S7. In other words, no test is performed until the predetermined time TMRFD1# has elapsed after the steps S 1 and S2 have been executed. The inclusion of this delay time until the test is begun is to avoid an incorrect test result during hot reset when the engine is restarted immediately after it has stopped. During hot reset, some time is necessary from when the radiator fan operates to when the cooling water temperature falls. Therefore, if a cooling water temperature TWN immediately after hot reset is above a determining value TWRFDG# described hereinafter, it is not due to a fault in the radiator fan.

If this delay time were not included and the routine advanced to the step S7 immediately after the test permission conditions of the steps S1 and S2 were satisfied, it would be incorrectly determined that there was a fault in the radiator fan. This delay time is set based on the time it takes for the cooling water temperature to fall to a certain level after the radiator fan has begun operating.

The steps S7, S8 are steps for determining a fault in the radiator fan.

[1] The cooling water temperature TWN is equal to or greater than a first predetermined value TWRFDG# (step S7).

[2] A timer value TMRFA is equal to or greater than a predetermined value TMRFD3# ( step S8 ).

When both the above conditions are satisfied, it is determined that the radiator fan has a fault, and the routine advances to a step S10.

The determining value TWRFDG# in the step S7 is a temperature that will definitely cause the engine to overheat, and it is set for example to 145° C.

The predetermined value TMRFD3# in the step S8 is set to, for example, 60 seconds. In other words, the condition that the relation TWN≧TWRFDG# holds continuously for a time equal to TMRFD3# or longer is added to the fault test conditions, so even if the condition TWN≧TWRFDG# is momentarily satisfied, it is not immediately determined that a fault has occurred. It may momentarily transpire that the cooling water temperature is equal to or greater than the first predetermined value TWRFDG# even if the radiator fan is functioning correctly. In this case, if it were immediately determined that the radiator fan had a fault, there is a possibility that this test result would be incorrect. The probability of making such an erroneous diagnosis is therefore reduced by specifying that the relation TWN≧TWRFDG# holds for a time equal to TMRFD3# or longer as the fault condition. The reason for incrementing the timer value TMRFA in the step S9 is to determine whether or not the condition of [1] holds for a time equal to TMRFD3# or longer.

If the aforesaid condition [1] continued for a time equal to TMRFD3#, a test code is examined in a step S10. The initial value of the test code is "0". If the test code is "0", this is the first time that a fault has been determined. In this case, the test code is set to "1" in a step S11, and the test for this engine run is terminated. The value of tile test code is also backed up after the engine has stopped. However, no warning is issued yet.

After the test code has been set equal to 1, when it is again determined by the aforesaid process that there is a fault for the next engine run, the routine advances to a step S12 since the test code was 1 during the immediately preceding run. In the step S12, a warning lamp lights on the driver's panel in the passenger compartment of the vehicle. Instead of a warning lamp lighting, any other warning means such as a warning buzzer may of course be used. If the driver releases the accelerator pedal to reduce the engine load when he receives a warning, overheating of the engine may be prevented.

Figure 3:
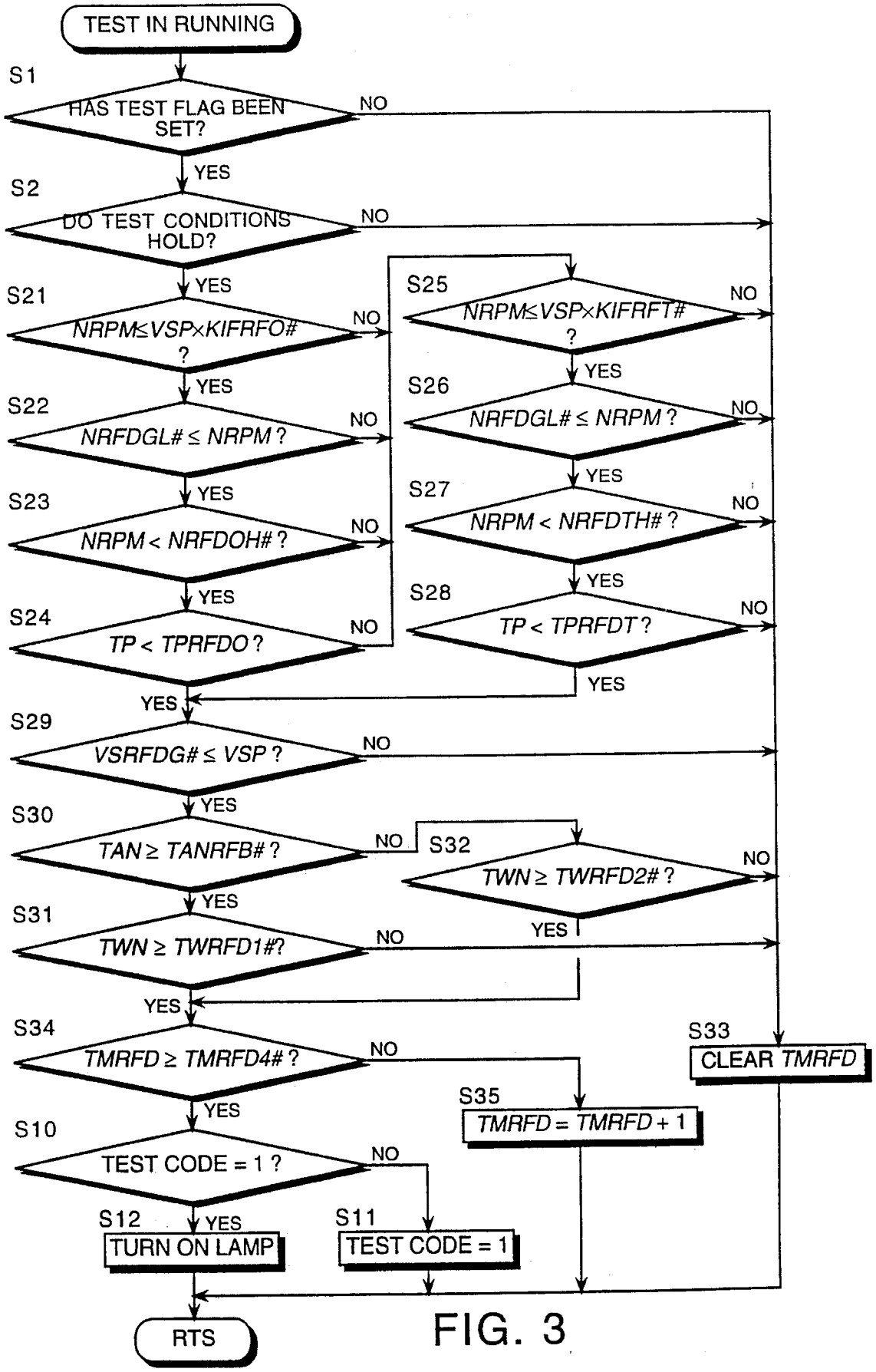
FIG. 3 is a flowchart showing a process of another fault test according to this invention that is performed only when the vehicle is moving.

FIG. 3 is a flowchart of a fault diagnosis process invoked when the vehicle is running. This process may be executed at intervals of for example 2 ms. The flow during regular testing and the flow while the vehicle is moving may occur in parallel. Parts identical to FIG. 2 are represented by the same step numbers, and their description is omitted.

In steps S21–S29, it is determined whether or not the vehicle is in the test region for vehicle motion. The test region for vehicle motion is a high speed gear ratio region comprising an overdrive gear and a top gear, and it is also a region where the engine is running under low load at low or medium speed.

In vehicles fitted with an automatic transmission, the minimum gear ratio is obtained from the overdrive gear, and the next smallest gear ratio is obtained from the top gear. In other words. In a vehicle with five gears, fifth gear is the overdrive gear and fourth gear is the top gear. However, in a vehicle with three gears there is no overdrive gear, and the third gear is treated as the top gear.

For the sake of simplicity, the region with minimum gear ratio will be referred to as the overdrive region and the region with the next smallest gear ratio as the top gear region even in the case of a manual transmission.

In a step S21, the engine speed NRPM (rpm) is compared with the product of vehicle speed VSP (km/h) and a predetermined value KIFRFO#. When NRPM≦VSP·KIFRFO#, it is determined that the vehicle is in the overdrive region, and the routine advances to steps S22 and S23. Herein, KIFRFO# is a set value related to a gear ratio for determining whether or not the vehicle is running with the overdrive gear, and it contains a value for converting vehicle speed to engine speed (rpm).

A rotation speed equivalent value (rpm) obtained by multiplying the vehicle speed (km/h) by KIFRFO# is an engine speed used for the purpose of defining the boundary of the overdrive region, and when the engine speed is less than this boundary value, it is determined that the engine is running with the overdrive gear.

Next, in the steps S22 and S23, it is determined whether or not the speed NRPM lies in the range NRFDGL#≦NRPM <NRFDOH#. If it is within this range, it is determined that the engine is in the low or medium speed regions, and the routine advances to the step S24. NRFDGL# is set to a value defining the lower limit of the low and medium speed regions, e.g. 1000 rpm, and NRFDOH# is set to a value defining tile upper limit of the low and medium speed regions, e.g. 2800–3200 rpm.

Figure 4:
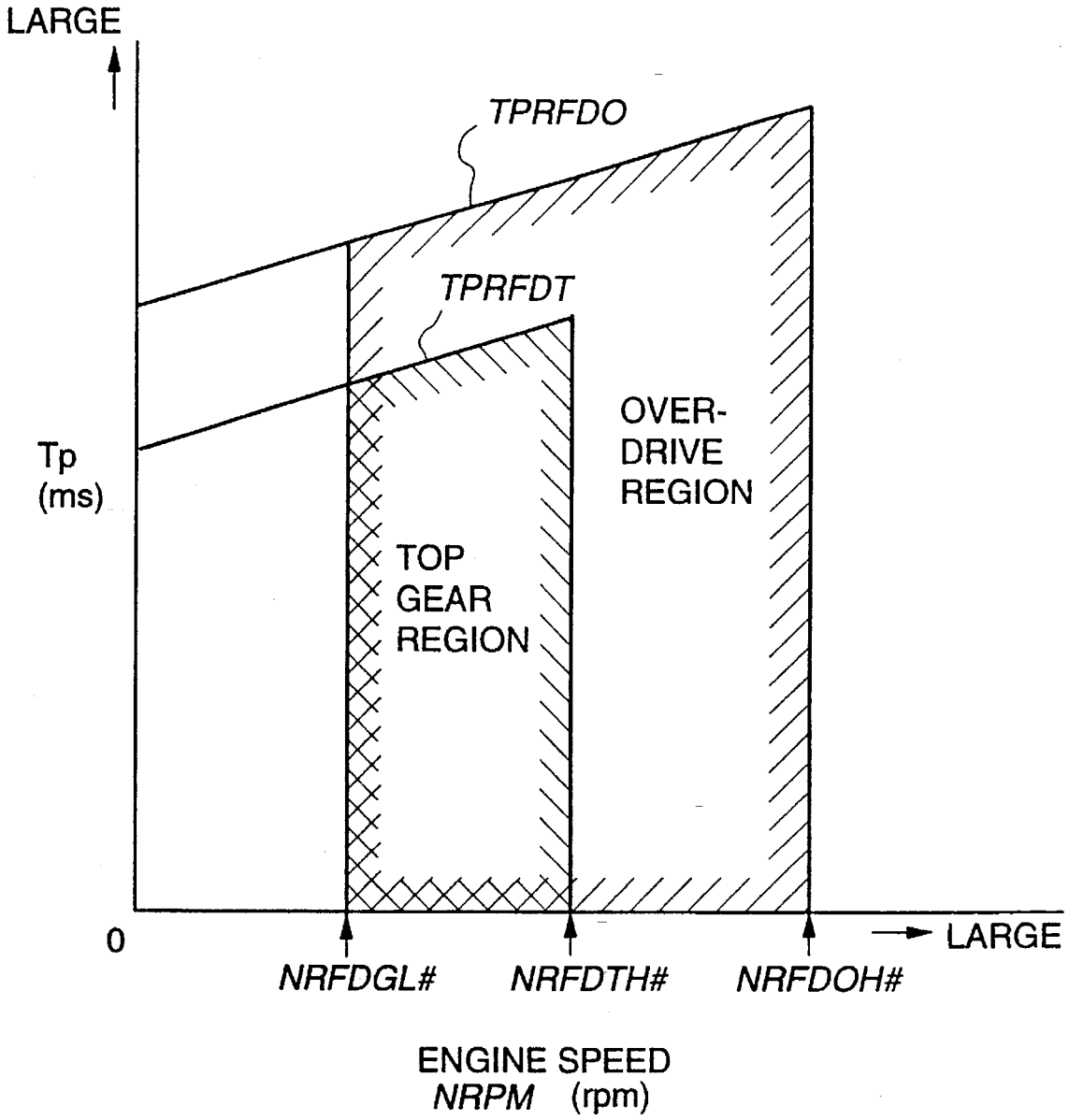
FIG. 4 is a graph showing a test region according to this invention.

In the step S24, a basic engine fuel injection pulse width Tp is compared with a predetermined value TPRFDO. If Tp<TPRFDO, it is determined that the normal running load is In a low load region and the routine advances to a step S29. Tp is an amount corresponding to the engine load. The predetermined value TPRFDO is a value obtained by converting the normal running load to an injection pulse width. Theoretically, TPRFDO increases as the engine speed rises, as shown in FIG. 4.

The basic pulse width Tp is a basic parameter of fuel injection amount control. The routine for controlling fuel injection amount will not be described here, but for the purpose of controlling fuel injection, the basic pulse width Tp is calculated at intervals of 4 ms by an equation Tp=(Q/NPRM).K (where K is a constant), using an air flowrate Q detected by an air flow meter and the engine speed NPRM. This result is used for testing the cooling device while the vehicle is in motion.

In the step S29, the vehicle speed VSP is compared with a predetermined value VSRFDG#, and when VSRFDG#≦VSP, it is determined that the vehicle is in motion and the routine advances to a step S30. Herein, it is sufficient to determine whether or not the vehicle is moving. The predetermined value VSRFDG# may be set for example to 2 km/h.

In steps S25–S28, as in the steps S21–S24, it is determined that the vehicle is in the low load and low or medium speed regions with top gear when all the following conditions are satisfied, and the routine advances to the step S29.

[1] NRPM≦⊇VSP.KIFRFT#(step S25), i.e. the vehicle is running with the top gear. The gear ratio KIFRFT# for determining the top gear region is a lager value than the gear ratio KIFRFO# for determining the overdrive region in the step S21.

[2] NRFDGL#≦NRPM<NRFDTH# (steps S26, S27). This is the low or medium speed region. The upper limit NRFDT# is smaller than the upper limit NRFDOH# in the step S23, and is set for example to 1800–2000 rpm.

[3] Tp<TPRFDT (step 28). This is the low load region under normal running loads. The predetermined value TPRFDT also is a value that increases with rise of engine speed NRPM as shown in FIG. 4. The predetermined value TPRFDT is smaller than the predetermined value TPRFDO in the step S24.

Summarizing the steps S21–S28, the conditions when the vehicle is in the overdrive region, the low or medium speed region and low load region, or when it is in the top gear region, the low or medium speed region and the low load region, are taken as the test region while the vehicle is in motion.

From the viewpoint of engine temperature conditions, the high speed gear ratio region (overdrive and top gear regions) is less severe than the low speed gear ratio region. Likewise, the low and medium speed regions are less severe than the high speed region, and further as regards normal engine running load, the low load region is less severe than the medium or high load regions. When all these conditions are satisfied, therefore, the engine temperature conditions are the least severe. By performing a test only under these conditions, higher precision may be obtained compared to the case where it is performed in the low gear ratio region (e.g. first or second gears), the medium and high load region during normal running loads, or the high speed region.

Further, these test conditions are appropriate due to the fact that there is no need to select severe conditions for engine temperature, and due to the fact that, as it is only necessary to perform one test on each engine run, an opportunity to satisfy all the aforesaid conditions may easily be obtained.

FIG. 4 shows the test region while the vehicle is in motion in the general case. The actual region will be different depending on engine and radiator layout, the capacity of the radiator fan and the outer profile of the radiator.

In the actual execution of the test performed in steps S30–S32, an intake temperature TAN and a predetermined value TANRFB# are compared, and a determination is made by changing the aforesaid second determining value when the intake temperature is normal (TAN<TANRFB#) and when the intake temperature is extremely high (TAN≧TANRFB#). The predetermined value TANRFB# is set for example to 40° C.

[1] When the intake temperature is normal

When the cooling water temperature TWN is equal to or greater than a second determining value TWRFD2#, it is determined that the radiator fan has a fault.

[2] When the intake temperature is extremely high

When the cooling water temperature is equal to or greater than a third determining value TWRFD1#, it is determined that the radiator fan has a fault.

These determining values TWRFD2# and TWRFD1# are both set to be less first determining value TWRFD# for the regular test. The determining values for the test when the vehicle is moving are arranged to be less than the determining value for the regular test in order to make allowance for the fact that the radiator fan is cooled also by the wind set up by the motion of the vehicle. This setting ensures high test precision when the vehicle is moving.

Further, the third determining value TWRFD1# when the intake temperature is extremely high, is greater than the second determining value TWRFD2# in the normal case. For example TWRFD2# may be set to 120° C., and TWRFD1# may be set to 130° C.

The determining value for the case when the intake temperature is extremely high is arranged to be greater than the determining value for the normal case in order to make allowance for the fact that the performance of the radiator fan falls the higher the intake temperature. If the determining value for the normal intake temperature were used for the case where the intake temperature is extremely high, there is a possibility of making an incorrect diagnosis. By setting the determining value for the test when the vehicle is moving, to be greater when the intake temperature TAN is extremely high than when it is normal, a good test precision when the intake temperature is extremely high is ensured.

When it is determined that the radiator fan has a fault, the timer value TMRFD is compared with a predetermined value TMRFD4# in a step S34. If TMRFD<TMRFD4# the routine advances to a step S35, the timer value TMRFD is incremented, and when TMRFD≧TMRFD4#, the routine advances to the step S10. The predetermined value may for example be set to 30 seconds.

The predetermined value TMRFD4# in the step S34 is a delay time similarly to the predetermined value TMRFD3# in the step S8. If the intake temperature is less than the predetermined value before TMRFD≧TMRFD4#, therefore, the routine advances to a step S33 and the timer value TMRFD is cleared.

This delay time is added to the test conditions so that it is not immediately determined that the radiator fan has a fault when the cooling water temperature momentarily rises to and above a predetermined value. While the vehicle is running, it may frequently occur that the cooling water temperature increases to and above a predetermined value. By adding the delay time to the test conditions in such a case, the possibility that this momentary rise of cooling water temperature is misinterpreted as a fault in the radiator fan, is avoided.

The predetermined value TMRFD4# was set to half of the predetermined value TMRFD3# during the regular test in order to allow for the effect of wind set up by the motion of the vehicle.

In this manner, even if a fault does occur in the radiator fan while the vehicle is moving, the driver is alerted to this fact. The driver may then prevent overheating from occurring by dropping his speed.

According to the aforesaid embodiment, the engine temperature was represented by the cooling water temperature, however the engine temperature may also be represented by lubricating oil temperature. Further, according to these embodiments, the invention was applied to an electrically actuated radiator fan, but it may be applied also to a mechanical fan driven by a crankshaft or the like.

Still further, according to these embodiments, a constant running load was used as a load for determining the test region while the vehicle is moving, but more simply, the actual engine load may be used. In this case, the low engine load region is the test region.

The embodiments of this invention in which an exclusive property or privilege is claimed are defined as follows:

1. A fault diagnosis device for a radiator fan that cools an engine of a vehicle comprising:

means for detecting a temperature of said engine, determining means that functions so as to determine whether or not a preset test condition is satisfied, and to determine that said radiator fan has a fault when said engine temperature is equal to or greater than a preset first determining value when said condition is satisfied, and means for generating a warning when said determining means has determined that said fan has a fault, wherein said determining means functions also so as to determine whether or not said vehicle is moving, and to determine that said radiator fan has a fault when said vehicle is in motion and said engine temperature is equal to or greater than a second determining value that is less than said first determining value.

2. A fault diagnosis device in claim 1, wherein said determining means functions also so as not to determine that said radiator fan has a fault when said condition does not hold for a predetermined time.

3. A fault diagnosis device as defined in claim 1, wherein said device further comprises timer means for measuring an elapsed time for which said engine temperature is equal to or greater than said second determining value, and said determining means functions also so as not to determine that said radiator fan has a fault when said elapsed time does not exceed said predetermined value.

4. A fault diagnosis device as defined in claim 1 wherein said device further comprises means for detecting a temperature of air provided to said engine, and said determining means functions also so as to increase said second determining value when said temperature is greater than a preset predetermined value.

5. A fault diagnosis device as defined in claim 1, wherein said vehicle comprises a high speed gear and a low speed gear that reduce said engine speed, said device further comprises means for detecting an applied gear, and said determining means functions also so as not to determine that said radiator fan has a fault when said high speed gear is not applied.

6. A fault diagnosis device as defined in claim 1, wherein said device further comprises means for detecting an engine load, and said determining means function also so as not to determine that said radiator fan has a fault when said engine load is greater than a predetermined value.

7. A fault diagnosis device as defined in claim 1, wherein said device further comprises means for detecting an engine speed, and said determining means functions also so as not to determine that said radiator fan has a fault when said engine speed is greater than a predetermined value.

8. A fault diagnosing system for a radiator fan used to cool an engine disposed in a vehicle, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; said second coolant temperature threshold value being lower than said first coolant temperature threshold value;

means for determining whether the vehicle is in motion; and means for determining that a fault exists in the radiator fan when the engine coolant temperature is determined to exceed the first threshold value and also when the engine coolant temperature is determined to exceed the second threshold value and the vehicle is determined to be in motion.

9. A fault diagnosing system according to claim 8, further comprising;

means for sensing a temperature of intake air to the engine;

means for determining if the sensed intake air temperature exceeds an air temperature threshold value; and means for selecting the second coolant temperature threshold value to be a first temperature value if the sensed intake air temperature is determined to exceed the air temperature threshold value, and to be a second temperature value, which is less than the first temperature value, if the sensed intake air temperature is determined to be less than the air temperature threshold value.

10. A fault diagnosing system for a radiator fan used to cool an engine disposed in a vehicle, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; said second coolant temperature threshold value being lower than said first coolant temperature threshold value;

means for determining whether the vehicle is in motion;

means for determining whether the engine has continuously operated for a first time period; and means for determining that a fault exists in the radiator fan when the engine coolant temperature is determined to exceed the first threshold value and the engine is determined to have continuously operated for at least the first time period, and also when the engine coolant temperature is determined to exceed the second threshold value and the vehicle is determined to be in motion.

11. A fault diagnosing system for a radiator fan used to cool an engine disposed in a vehicle, comprising:

means for sensing an engine coolant temperature;

means for determining whether the sensed engine coolant temperature exceeds a first coolant temperature threshold value for a first time period;

means for determining whether the sensed engine coolant temperature exceeds a second coolant temperature threshold value; said second coolant temperature threshold value being lower than said first coolant temperature threshold value;

means for determining whether the vehicle is in motion;

means for determining whether the engine has continuously operated for a second time period; and means for determining that a fault exists in the radiator fan when the engine coolant temperature is determined to exceed the first threshold value for at least the first time period and the engine is determined to have continuously operated for at least the second time period, and also when the engine coolant temperature is determined to exceed the second threshold value and the vehicle is determined to be in motion.

12. A fault diagnosing system for a radiator fan used to cool an engine disposed in a vehicle, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; for a first time period; said second coolant temperature threshold value being lower than said first coolant temperature threshold value;

means for determining whether the vehicle is in motion; and means for determining that a fault exists in the radiator fan when the engine coolant temperature is determined to exceed the first threshold value and also when the engine coolant temperature is determined to exceed the second threshold value for at least the first time period and the vehicle is determined to be in motion.

13. A fault diagnosing system for a radiator fan used to cool an engine disposed in a vehicle, the vehicle having a transmission connected to the engine, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; said second coolant temperature threshold value being lower than said first coolant temperature threshold value;

means for determining whether the vehicle is in motion;

means for determining whether the transmission is in a high speed gear or a low speed gear; and means for determining that a fault exists in the radiator fan when the engine coolant temperature is determined to exceed the first threshold value, and also when: the engine coolant temperature is determined to exceed the second threshold value, the vehicle is determined to be in motion and the transmission is determined to be in high speed gear.

14. A fault diagnosing system for a radiator fan used to cool an engine disposed in a vehicle, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; said second coolant temperature threshold value being lower than said first coolant temperature threshold value;

means for determining whether the vehicle is in motion;

means for detecting a load on the engine;

means for determining whether the detected load exceeds a load threshold value; and means for determining that a fault exists in the radiator fan when the engine coolant temperature is determined to exceed the first threshold value and also when: the engine coolant temperature is determined to exceed the second threshold value, the vehicle is determined to be in motion and the detected load is determined to be less than the load threshold value.

15. A fault diagnosing system for a radiator fan used to cool an engine disposed in a vehicle, comprising:

means for sensing an engine coolant temperature;

means for determining whether the sensed engine coolant temperature exceeds a first coolant temperature threshold value;

means for determining whether the sensed engine coolant temperature exceeds a second coolant temperature threshold value; said second coolant temperature threshold value being lower than said first coolant temperature threshold value;

means for determining whether the vehicle is in motion;

means for detecting an engine speed;

means for determining whether the detected engine speed exceeds an engine speed threshold value; and means for determining that a fault exists in the radiator fan when the engine coolant temperature is determined to exceed the first threshold value, and also when: the engine coolant temperature is determined to exceed the second threshold value, the vehicle is determined to be in motion and the detected engine speed is determined to be less than the engine speed threshold value.

* * * * *